US009909521B2

(12) United States Patent
Ikemoto

(10) Patent No.: US 9,909,521 B2
(45) Date of Patent: Mar. 6, 2018

(54) FUEL INJECTION APPARATUS AND CONTROL METHOD THEREOF

(71) Applicant: Masato Ikemoto, Susono (JP)

(72) Inventor: Masato Ikemoto, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 240 days.

(21) Appl. No.: 14/647,560

(22) PCT Filed: Nov. 25, 2013

(86) PCT No.: PCT/IB2013/002927
§ 371 (c)(1),
(2) Date: May 27, 2015

(87) PCT Pub. No.: WO2014/083424
PCT Pub. Date: Jun. 5, 2014

(65) Prior Publication Data

US 2015/0300286 A1 Oct. 22, 2015

(30) Foreign Application Priority Data

Nov. 28, 2012 (JP) ..... 2012-260056

(51) Int. Cl.
*F02D 41/38* (2006.01)
*F02D 41/22* (2006.01)
*F02M 65/00* (2006.01)

(52) U.S. Cl.
CPC ..... *F02D 41/38* (2013.01); *F02D 41/22* (2013.01); *F02M 65/00* (2013.01);
(Continued)

(58) Field of Classification Search
CPC ..... F02D 2041/224; F02D 2200/0602; F02D 2200/0618; F02D 2200/063; F02D 41/22; F02D 41/38; F02M 65/00
See application file for complete search history.

(56) References Cited

U.S. PATENT DOCUMENTS 8,099,231 B1 * 1/2012 Suwa ..... F02D 41/221 123/406.21
8,406,982 B2 * 3/2013 Yamada ..... F02D 41/3809 123/447

(Continued)

FOREIGN PATENT DOCUMENTS

CN 102644515 A 8/2012
DE 102011075947 A1 11/2012

(Continued)

OTHER PUBLICATIONS

M.I. Karamangil et al., "Experimental Investigation of Effect of Corrosion on Injected Fuel Quantity and Spray Geometry in the Diesel Injection Nozzles", Fuel, vol. 112, pp. 531-536 (2013).

(Continued)

*Primary Examiner* — Freddie Kirkland, III

(74) *Attorney, Agent, or Firm* — Finnegan, Henderson, Farabow, Garrett & Dunner, LLP

(57) ABSTRACT

A fuel injection apparatus includes: a first obtaining unit that obtains a first index relating to an opening behavior of an injector; a second obtaining unit that obtains at least one of a second index relating to a maximum injection rate of the injector and a third index relating to an injection period; and a calculation unit that determines that injection hole corrosion has occurred in the injector when a first condition relating to the first index is established and at least one of a second condition relating to the second index and a third condition relating to the third index is established.

8 Claims, 17 Drawing Sheets

(52) U.S. Cl.
CPC ..... *F02D 2041/224* (2013.01); *F02D 2200/0602* (2013.01); *F02D 2200/063* (2013.01); *F02D 2200/0618* (2013.01)

(56) References Cited

U.S. PATENT DOCUMENTS

| | | | | |
|---|---|---|---|---|
| 8,849,592 | B2 * | 9/2014 | Takashima | F02D 41/3863 702/50 |
| 9,002,666 | B2 * | 4/2015 | Takashima | F02D 41/221 702/50 |
| 9,528,459 | B2 * | 12/2016 | Ikemoto | F02D 41/042 |
| 2010/0250095 | A1 | 9/2010 | Yamada et al. | |
| 2012/0072134 | A1 | 3/2012 | Takashima | |
| 2012/0209544 | A1 | 8/2012 | Takashima | |
| 2015/0354475 | A1 * | 12/2015 | Ikemoto | F02D 35/025 123/41.02 |
| 2016/0334304 | A1 * | 11/2016 | Ikemoto | F02D 41/042 |

FOREIGN PATENT DOCUMENTS

| | | |
|---|---|---|
| JP | 51-72618 | 12/1974 |
| JP | 2001-280189 | 10/2001 |
| JP | 2010-65537 | 3/2010 |
| JP | 2010-223185 | 10/2010 |
| JP | 2012-127327 | 7/2012 |
| JP | 2012-158999 | 8/2012 |

OTHER PUBLICATIONS

R.A. Taflan et al., "Statistical Corrosion Evaluation of Nozzles Used in Diesel CRI Systems", Fuel, vol. 102, pp. 41-48, (2012).

* cited by examiner

FUEL INLET PRESSURE WAVEFORM

EFFECT OF INJECTION HOLE FLOW RATE

RELATIONSHIP BETWEEN INJECTION HOLE CORROSION AMOUNT AND MAXIMUM INJECTION RATE

RELATIONSHIP BETWEEN INJECTION HOLE CORROSION AMOUNT, INJECTION PRESSURE, AND SMOKE GENERATION AMOUNT

VARIATION IN NEEDLE SPEED AND NEEDLE LIFT

FUEL INJECTION APPARATUS AND CONTROL METHOD THEREOF

CROSS-REFERENCE TO RELATED APPLICATIONS

This application is a national phase application of International Application No. PCT/IB2013/002927, filed Nov. 25, 2013, and claims the priority of Japanese Application No. 2012-260056, filed Nov. 28, 2012, the content of both of which is incorporated herein by reference.

BACKGROUND OF THE INVENTION

1. Field of the Invention

The invention relates to a fuel injection apparatus and a control method thereof.

2. Description of Related Art

In recent years, various measures to address aging variation in an opening/closing operation of a fuel injection valve (an injector) have been proposed. For example, in a fuel injection valve proposed in Japanese Patent Application Publication No. 2001-280189 (JP 2001-280189 A), in order to address variation in an injection amount characteristic caused by aging variation in a fuel injection valve that uses gas fuel or corrosive fuel, variation in an opening/closing delay of the fuel injection valve is detected and a fuel injection pulse width is corrected accordingly. In this fuel injection valve, an initially set injection amount is maintained by correcting the fuel injection pulse width.

Incidentally, one cause of aging variation in the fuel injection valve is condensation of an acidic component of gas remaining in a cylinder. When the acidic component condenses and adheres to a tip end portion of the injector, an injection hole portion provided in the tip end portion of the injector may corrode. When the injection hole portion corrodes, atomization of the fuel injected from the ignition hole portion may be affected, and as a result, smoke may be generated.

In the fuel injection valve disclosed in JP 2001-280189 A, however, the effect of injection hole corrosion caused by condensed water is not taken into consideration. More specifically, the injection hole starts to corrode by the condensed water from an injection hole outlet in the vicinity of a combustion chamber, and therefore substantially no variation is seen in the fuel injection amount. Hence, it is difficult to diagnose injection hole corrosion accurately simply by detecting the opening/closing delay.

SUMMARY OF THE INVENTION

An object of the invention is therefore to provide a fuel injection apparatus and a control method thereof with which the presence in an injector of injection hole corrosion caused by condensed water can be determined appropriately.

A fuel injection apparatus according to a first aspect of the invention includes: a first obtaining unit that obtains a first index relating to an opening behavior of an injector; a second obtaining unit that obtains at least one of a second index relating to a maximum injection rate of the injector and a third index relating to an fuel injection period; and a calculation unit that determines that injection hole corrosion has occurred in the injector when a first condition relating to the first index is established and at least one of a second condition relating to the second index and a third condition relating to the third index is established.

When injection hole corrosion occurs in the injector due to the adhesion of condensed water, a diameter of an outlet side of the injection hole increases. In this case, the opening behavior of the injector does not differ greatly from that of a case in which injection hole corrosion has not occurred. On the other hand, variation is seen in at least one of the maximum injection rate and the injection period of the injector in comparison with a case in which injection hole corrosion has not occurred, and therefore the presence of injection hole corrosion caused by condensed water adhesion is determined using a combination of conditions relating to these indices.

Here, the first index relating to the opening behavior of the injector may be at least one of a reduction amount and a reduction speed of a fuel pressure immediately after the injector is opened. The first index relating to the opening behavior of the injector may also be at least one of a needle speed and a needle lift immediately after the injector is opened.

In the first aspect described above, the calculation unit may calculate a parameter on which to evaluate an injection hole corrosion amount in the injector on the basis of at least one of the second index and the third index, and correct the fuel pressure of the injector on the basis of the parameter. Further, the calculation unit may determine a correction amount to be applied to the fuel pressure on the basis of a smoke amount increase. When injection hole corrosion caused by condensed water adhesion occurs, substantially no variation occurs in a fuel injection amount per injection, and therefore an air-fuel ratio remains unchanged while a smoke characteristic deteriorates. Accordingly, the fuel pressure (an injection pressure) is varied so that the deterioration of the smoke characteristic can be offset. As a result, adverse effects caused by deterioration of the smoke characteristic, such as a filter blockage, for example, can be avoided.

A control method for a fuel injection apparatus according to a second aspect of the invention includes: obtaining a first index relating to an opening behavior of an injector; obtaining at least one of a second index relating to a maximum injection rate of the injector and a third index relating to an injection period; and determining that injection hole corrosion has occurred in the injector when a first condition relating to the first index is established and at least one of a second condition relating to the second index and a third condition relating to the third index is established.

With the fuel injection apparatus according to the first aspect of the invention and the control method for a fuel injection apparatus according to the second aspect of the invention, the presence in the injector of injection hole corrosion caused by condensed water can be determined appropriately.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
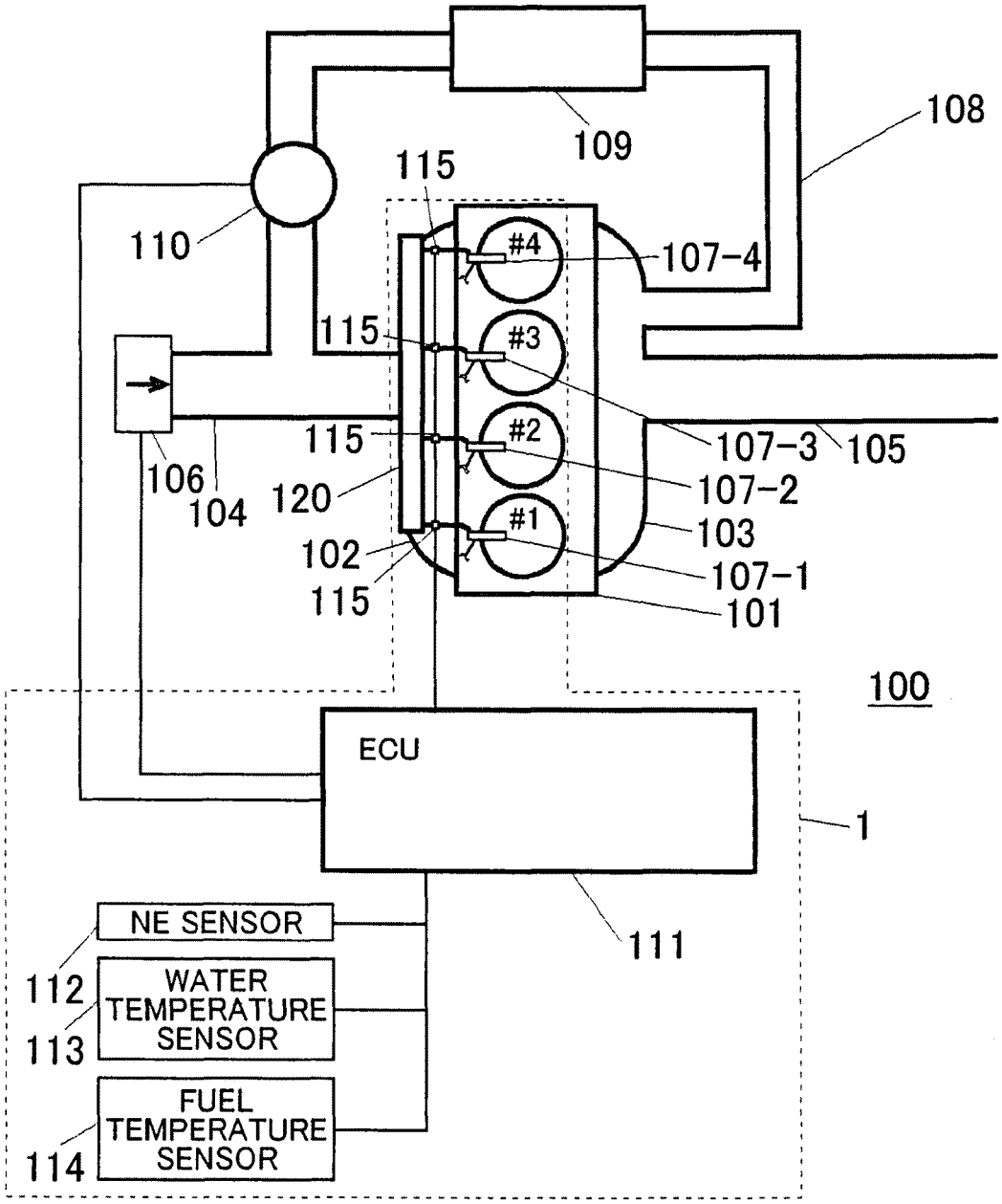
FIG. 1 is a schematic illustrative view showing a configuration of an engine incorporated with a fuel injection apparatus according to a first embodiment.

Embodiments of the invention will be described below with reference to the attached drawings. Note, however, that dimensions of respective parts, ratios, and so on illustrated in the drawings may not match actual dimensions, ratios, and so on perfectly. Further, in certain drawings, detailed parts may be omitted.

Figure 2:
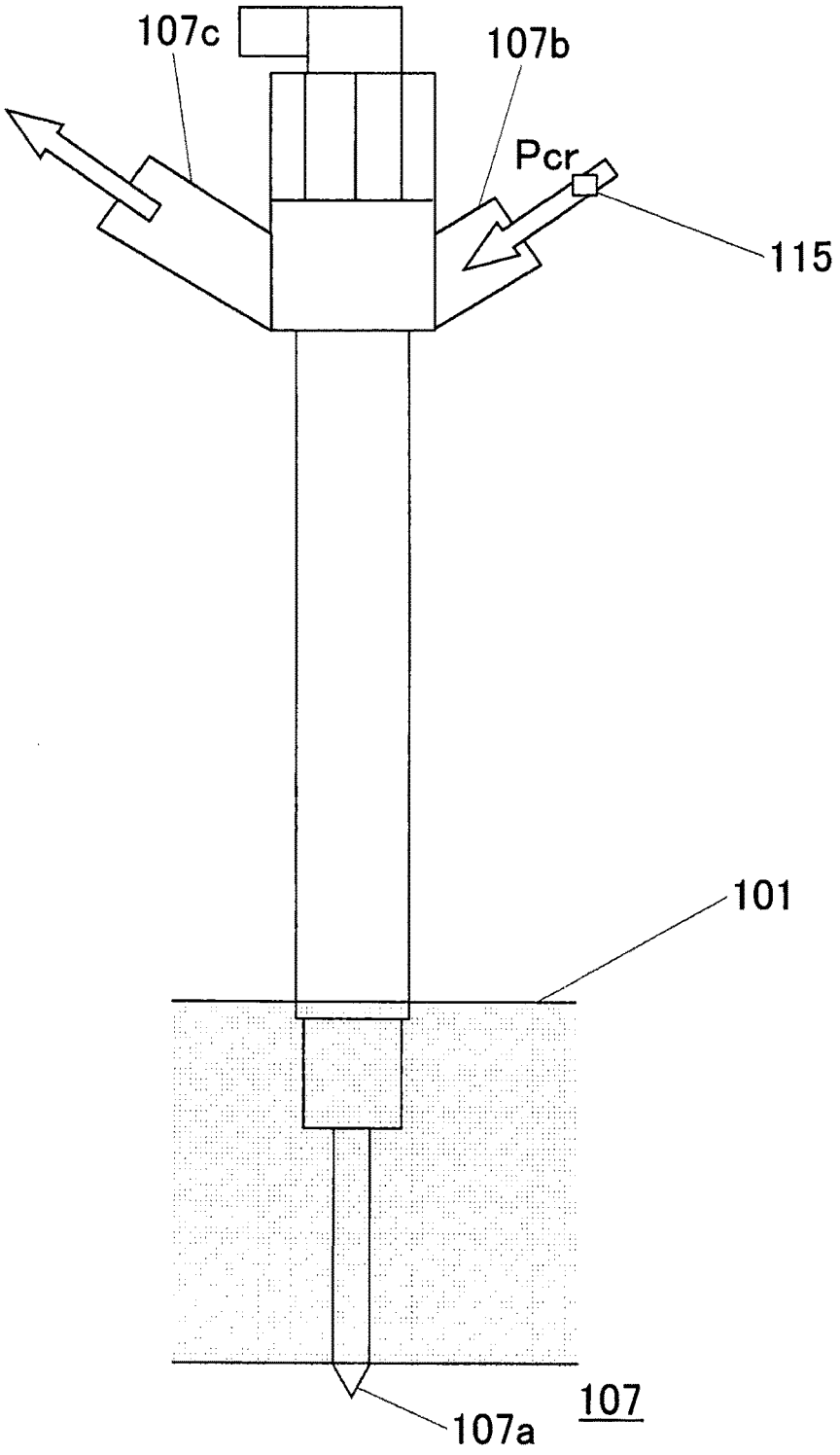
FIG. 2 is a schematic illustrative view showing a configuration of an injector.

(First Embodiment) FIG. 1 is a schematic illustrative view showing a configuration of an engine 100 incorporated with a fuel injection apparatus 1 according to this embodiment. FIG. 2 is a schematic illustrative view showing a configuration of an injector 107.

The engine 100 is an engine that performs in-cylinder injection, or more specifically a diesel engine. The engine 100 has four cylinders. The engine 100 includes an engine main body 101, and first to fourth cylinders are provided in the engine main body 101. The fuel injection apparatus 1 is incorporated into the engine 100. The fuel injection apparatus 1 includes first to fourth injectors 107-1 to 107-4 corresponding respectively to the first to fourth cylinders. More specifically, the first injector 107-1 is attached to the first cylinder, and a second injector 107-2 is attached to a second cylinder. A third injector 107-3 is attached to a third cylinder, and the fourth injector 107-4 is attached to the fourth cylinder. The first to fourth injectors 107-1 to 107-4 are respectively connected to a common rail 120, and high pressure fuel is supplied thereto from the common rail 120.

The engine 100 includes an intake manifold 102 and an exhaust manifold 103 attached to the engine main body 101. An intake pipe 104 is connected to the intake manifold 102. An exhaust pipe 105 and one end of an exhaust gas recirculation (EGR) passage 108 are connected to the exhaust manifold 103. Another end of the EGR passage 108 is connected to the intake pipe 104. An EGR cooler 109 is provided in the EGR passage 108. Further, an EGR valve 110 is provided in the EGR passage 108 to control a flow of exhaust gas. An air flow meter 106 is connected to the intake pipe 104. The air flow meter 106 is electrically connected to an electronic control unit (ECU) 111. An injector 107-*i* (where i is a cylinder number), or more specifically the first to fourth injectors 107-1 to 107-4, is electrically connected to the ECU 111. The ECU 111 issues engine stop fuel injection demands individually to the first to fourth injectors 107-1 to 107-4.

An NE sensor 112 that measures an engine rotation speed, a water temperature sensor 113 that measures a water temperature of cooling water, and a fuel temperature sensor 114 that measures a fuel temperature are electrically connected to the ECU 111. The ECU 111 performs various types of control around the engine.

Figure 3A:
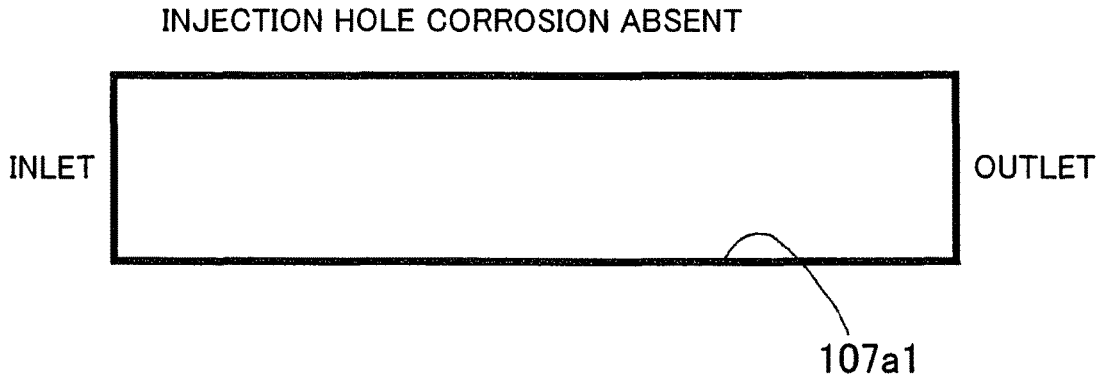
FIG. 3A is a schematic illustrative view showing a shape of an injection hole when injection hole corrosion has not occurred.
Figure 3B:
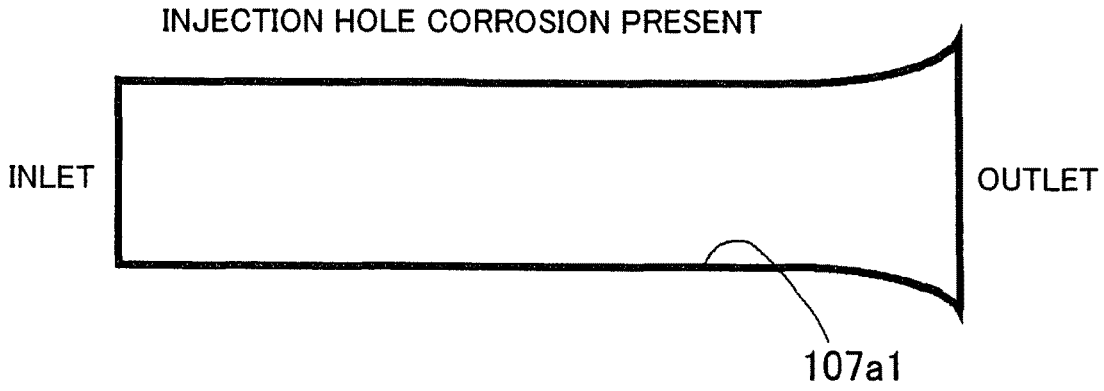
FIG. 3B is a schematic illustrative view showing the shape of the injection hole when injection hole corrosion has occurred.

Referring to FIG. 2, a nozzle body 107*a* is provided on a tip end portion of the injector 107. An injection hole 107*a*1 is provided in the nozzle body 107*a*. FIGS. 3A and 3B show a shape of the injection hole 107*a*1 schematically. More specifically, FIG. 3A is a schematic illustrative view showing the shape of the injection hole 107*a*1 when injection hole corrosion has not occurred, and FIG. 3B is a schematic illustrative view showing the shape of the injection hole 107*a*1 when injection hole corrosion has occurred. A needle valve is housed in an interior of the injector 107 to be free to slide. When condensed water adheres to the nozzle body 107*a* on the tip end portion of the injector 107, a diameter of an outlet side of the injection hole 107*a*1 increases, as shown in FIG. 3B. A corrosion effect on an inlet side, on the other hand, is small, and therefore a diameter of the inlet side is unlikely to vary. In other words, a feature of injection hole corrosion caused by the adhesion of condensed water is an increase in the diameter of the outlet side, which is exposed to an interior of a combustion chamber. Note that plating processing may be implemented on the injection hole 107*a*1. In this case, the injection hole corrosion includes peeling of the plating applied to the injection hole 107*a*1.

Referring to FIG. 2, a high pressure fuel portion 107*b* is provided on a base end side of the injector 107 to supply fuel into the interior of the injector 107. The high pressure fuel portion 107*b* is connected to the common rail 120, and a pressure gauge 115 that measures a fuel inlet pressure Pcr of the injector 107 is provided on a connection path between the high pressure fuel portion 107*b* and the common rail 120. The pressure gauge 115 measures a pressure (a fuel pressure) of injected fuel supplied from the common rail 120 to the injector 107. The fuel inlet pressure Pcr varies according to a fuel injection operation of the injector 107. The pressure gauge 115 is electrically connected to the ECU 111. The ECU 111 and the pressure gauge 115 are included in first obtaining unit that obtains a first index relating to an opening behavior of the injector 107 and second obtaining unit that obtains a second index relating to a maximum injection amount of the injector 107 and a third index relating to an injection period of the injector 107. The ECU 111 also functions as a calculation unit. The first index, second index, and third index will be described in detail below.

Figure 4:
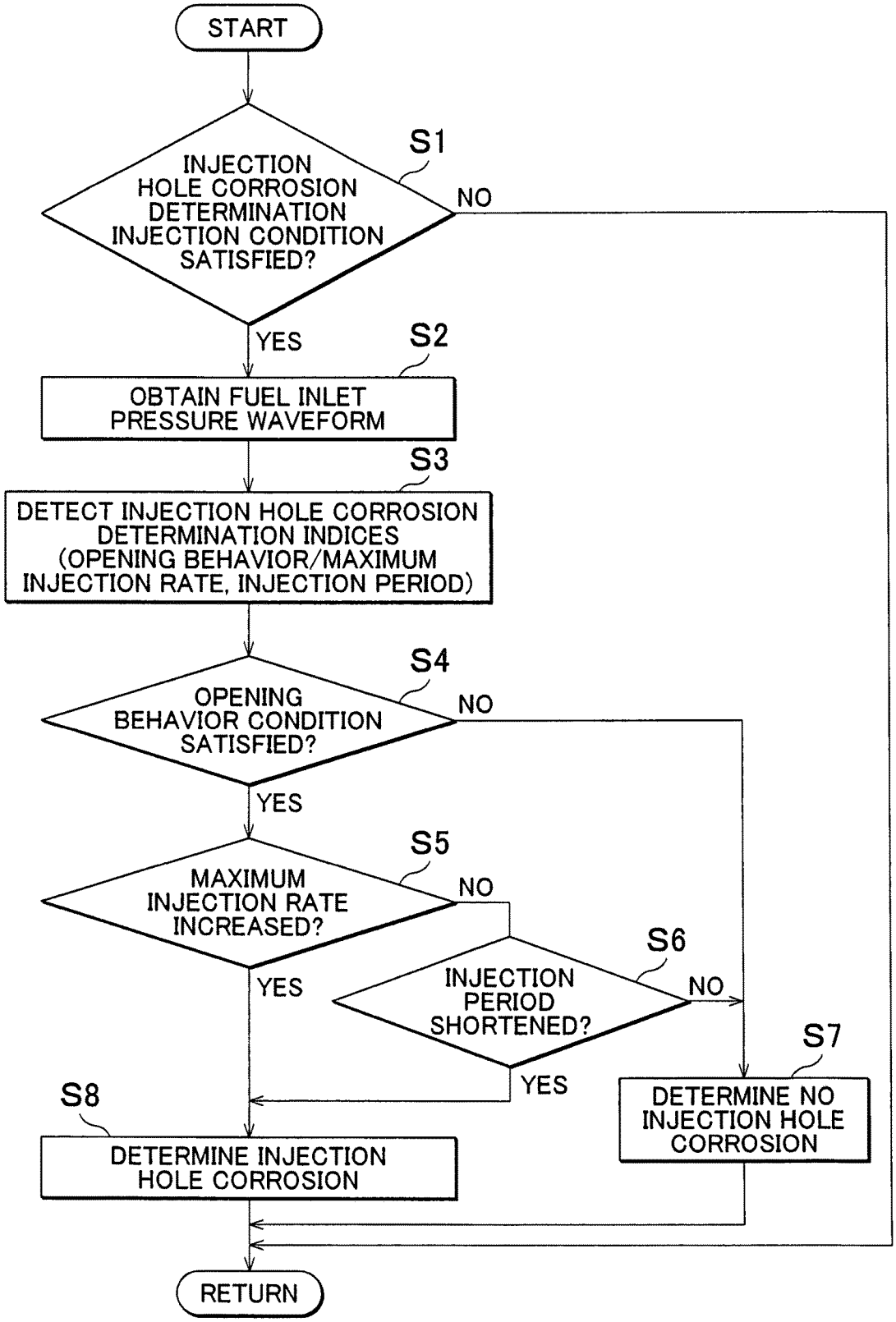
FIG. 4 is a flowchart showing an example of control of the fuel injection apparatus.
Figure 6:
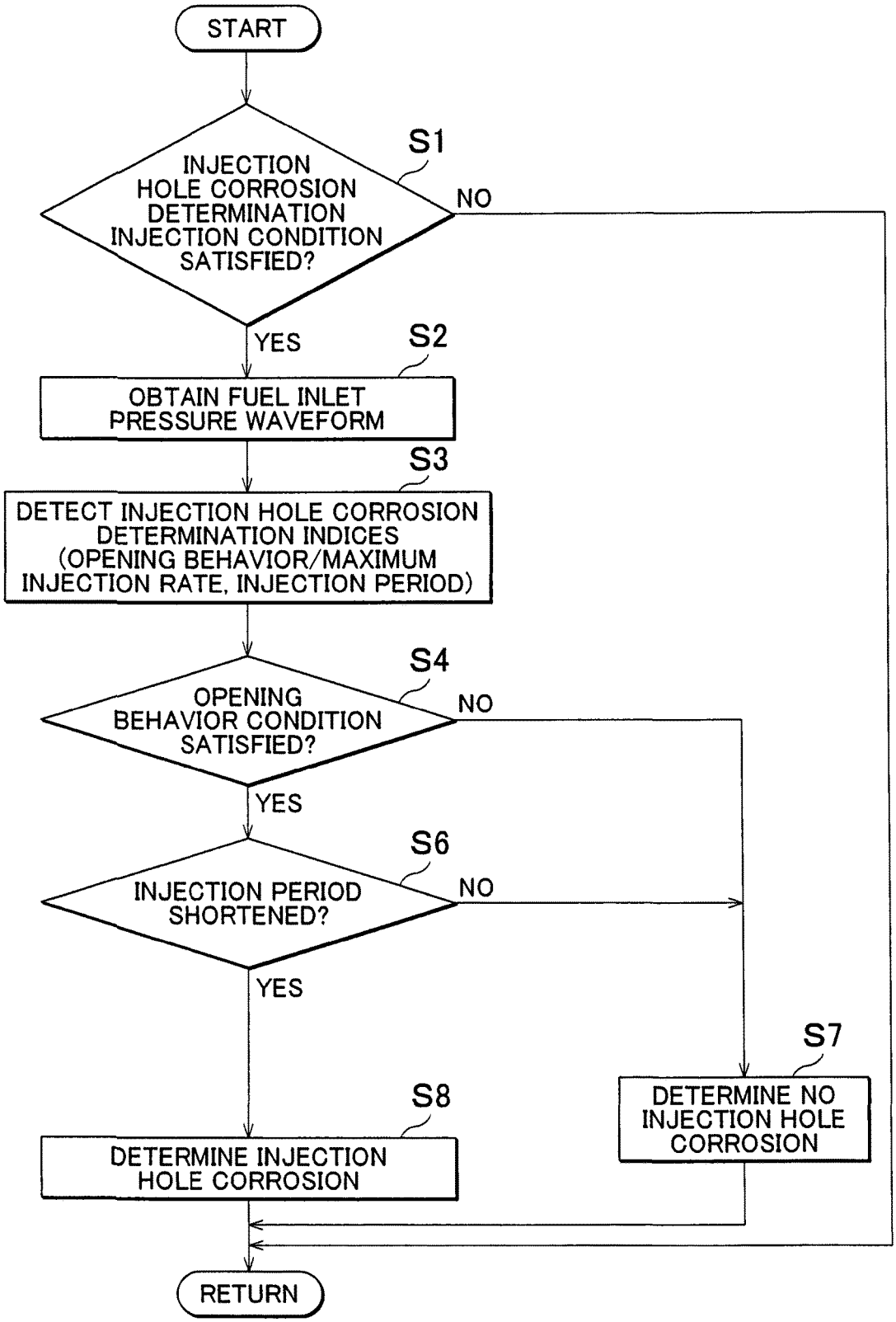
FIG. 6 is a flowchart showing a further example of control of the fuel injection apparatus.
Figure 7:
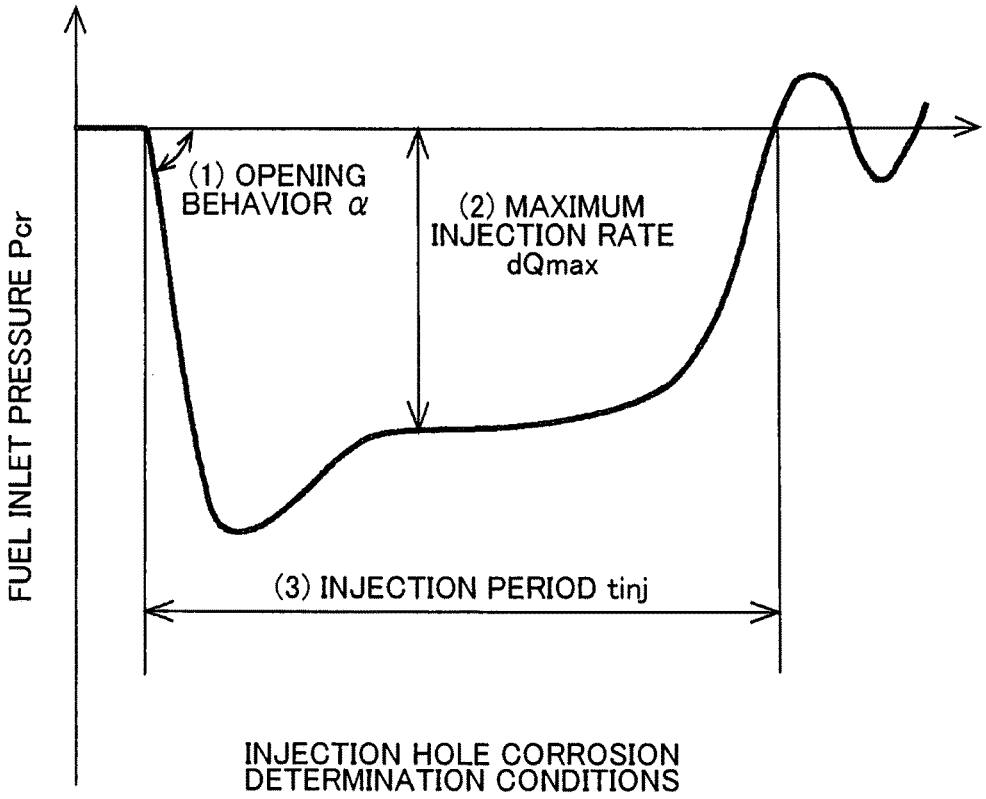
FIG. 7 is an illustrative view showing a first index, a second index, and a third index.
Figure 8:
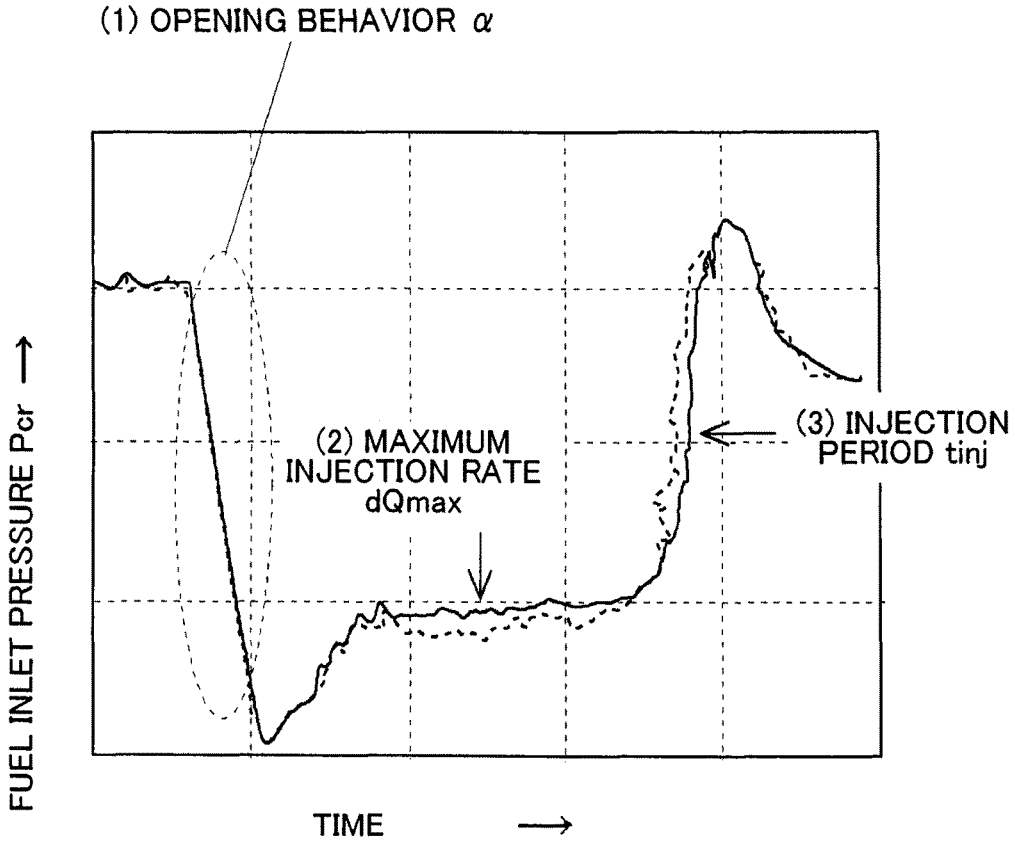
FIG. 8 is an illustrative view showing an example of a measurement result of a fuel inlet pressure waveform.
Figure 9:
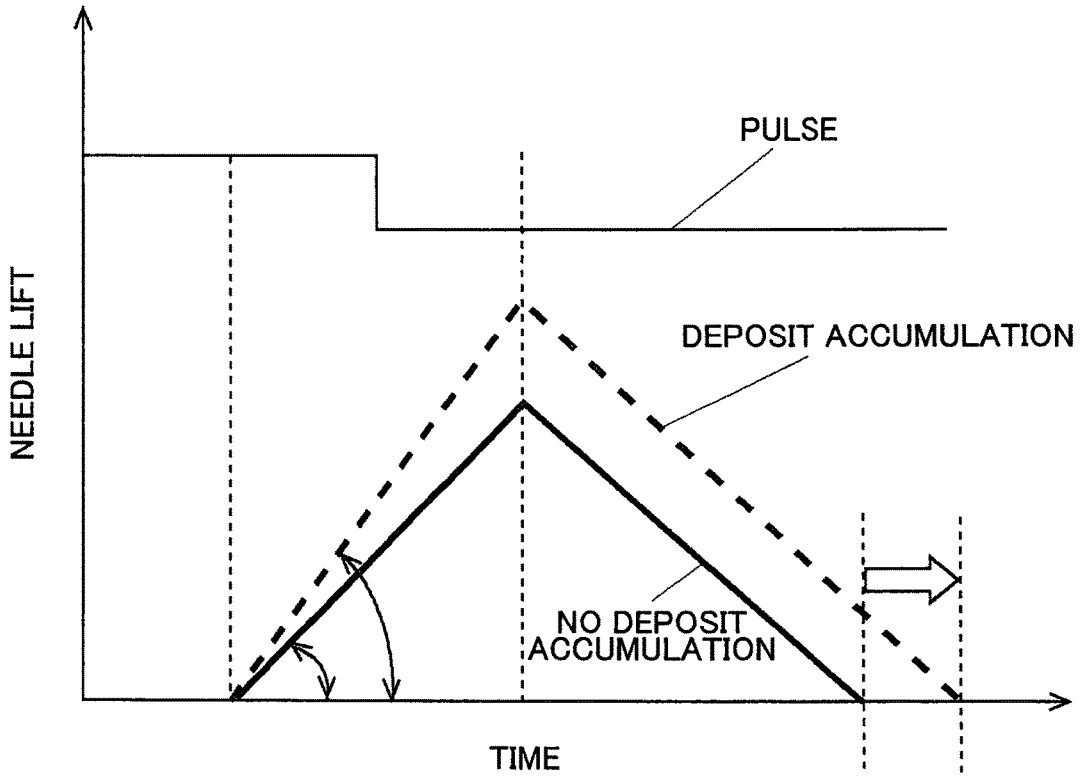
FIG. 9 is an illustrative view showing differences in a needle lift according to the presence or absence of deposit accumulation.
Figure 10:
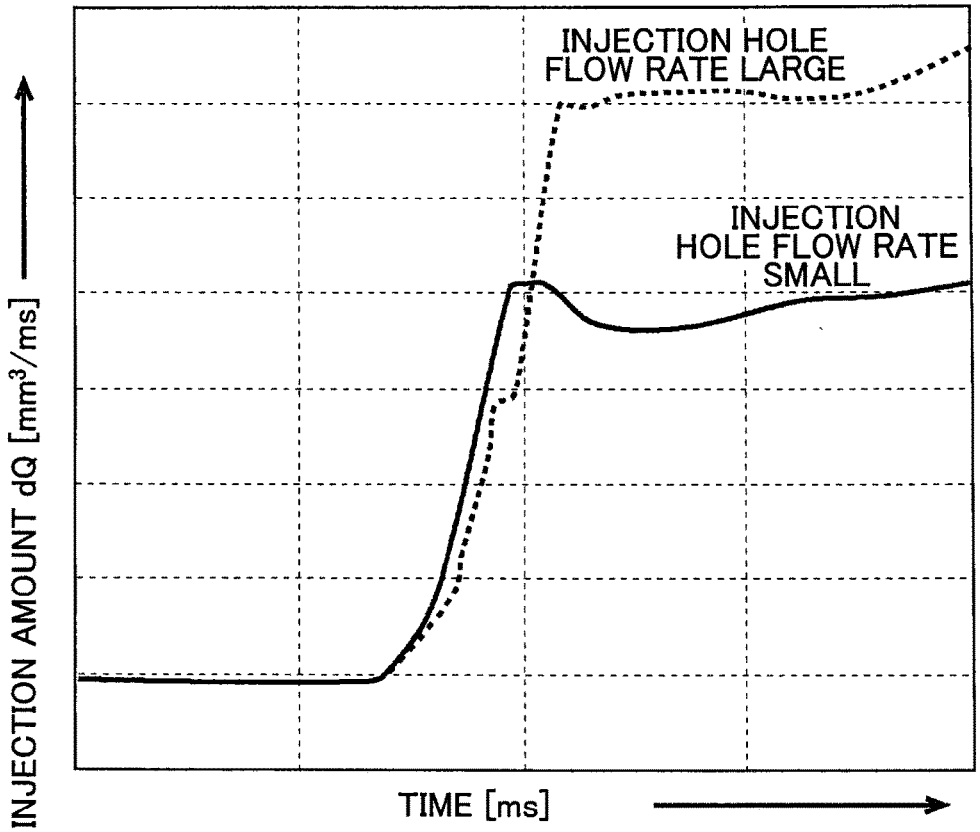
FIG. 10 is an illustrative view illustrating an effect of an injection hole flow rate.

An example of control of the fuel injection apparatus 1 will now be described with reference to FIGS. 4 to 8. FIG. 4 is a flowchart showing an example of control of the fuel injection apparatus 1. FIG. 7 is an illustrative view showing the first index, the second index, and the third index. FIG. 8 is an illustrative view showing an example of a measurement result of a fuel inlet pressure waveform. FIG. 9 is an illustrative view showing differences in a needle lift according to the presence or absence of deposit accumulation. FIG. 10 is an illustrative view illustrating an effect of an injection hole flow rate.

Before describing specific control, the first to third indices will be described with reference to FIG. 7. The first index is indicated by (1) Opening behavior a in FIG. 7. The second index is indicated by (2) Maximum injection rate dQmax in FIG. 7. The third index is indicated by (3) Injection period tinj in FIG. 7. All of these indices can be learned from variation in the fuel inlet pressure Pcr. Among conditions relating to the indices, a first condition relating to the first index must be established in order to determine that injection hole corrosion has occurred in the injector. Further, injection hole corrosion is determined to have occurred in the injector when at least one of a second condition relating to the second index and a third condition relating to the third index is established in addition to the first condition. Naturally it may also be determined that injection hole corrosion has occurred when all of the conditions are established.

Here, the first index may be set as at least one of a reduction amount and a reduction speed of the fuel pressure immediately after the injector 107 is opened. More specifically, the first index may be set as a reduction amount and a reduction speed of the fuel inlet pressure Pcr immediately after the injector 107 is opened. Accordingly, the condition relating to the first index may be set to be established when an amount of variation in the first index is equal to or smaller than a predetermined value. A needle of the injector 107 is lifted by a balance between a pressure in a suction chamber provided in the nozzle body 107*a*1 and a pressure in a control chamber provided on the base end side of the injector 107. Therefore, when no variation occurs in a relationship between the pressure in the suction chamber and the pressure in the control chamber, no variation is seen in the opening behavior α. Here, focusing on behavior occurring when the injector 107 is open, a flow coefficient in an initial injection stage is reduced by roughening of an inner surface of the injection hole, and therefore the pressure in the suction chamber does not decrease. Hence, even when injection hole corrosion occurs, variation in the behavior of the injector immediately after opening is very small. In other words, the amount of variation in the first index remains at or below the predetermined value. A condition in which the amount of variation in the first index remains at or below the predetermined value is a characteristic phenomenon observed when injection hole corrosion caused by the adhesion of condensed water occurs, and therefore this condition is a requirement for determining the presence of injection hole corrosion. Note that when the reduction amount or the reduction speed of the fuel inlet pressure Pcr immediately after opening is employed as the first index, as described above, a period serving as "immediately after opening" may be set as desired. In other words, the period "immediately after opening" may be set appropriately in consideration of specifications, characteristics, and individual differences in the injector 107. In FIGS. 7 and 8, for example, a period extending from opening (a start time) to a time (an end time) at which the fuel inlet pressure Pcr decreases by a maximum amount can be set as the period immediately after opening.

Differences a case in which the injection hole diameter varies (e.g., decreases) over an entire region of the injection hole and a case in which the injection hole diameter varies only at the outlet side will now be described with reference to FIGS. 9 and 10. Deposits typically accumulate over the entire region of the injection hole, and therefore, when deposits accumulate, the diameter of the injection hole varies over an entire lengthwise direction region. In other words, the injection hole corrodes in a different manner to a case in which the injection hole corrosion is caused by condensed water adhesion, in which only the diameter of the injection hole outlet side varies. When deposits accumulate, it becomes more difficult to inject the fuel, and therefore, in comparison with a case in which no deposits have accumulated, the pressure in the suction chamber increases from the initial injection stage. As a result, as shown in FIG. 7, a needle lift speed increases, and since the pressure in the suction chamber remains high, the needle lift also increases, leading to an increase in an open period (the injection period).

When the actual effect of the injection hole flow rate is evaluated using injectors having different injection hole diameters in order to compare opening behaviors according to the presence or absence of deposit accumulation, results shown in FIG. 10 are obtained. It is evident from FIG. 10 that when the injection hole flow rate increases, the injection amount of the injector also increases. Therefore, when the diameter varies (e.g., decreases) over the entire region of the injection hole, a difference in an initial injection rate is detected. When only the diameter of the injection hole at the outlet side varies (e.g., decreases) due to injection hole corrosion, on the other hand, no difference occurs in the opening behavior. Hence, in the fuel injection apparatus 1 according to this embodiment, the first condition relating to whether or not the amount of variation in the first index remains at or below the predetermined value is a requirement for determining that injection hole corrosion has occurred.

The second index relates to variation in the maximum injection rate dQmax. An injection rate dQ is calculated using following Equation (1).

$$dQ = Cd \times A \times \sqrt{(2 \times \Delta P/\rho)} \qquad \text{Equation (1)}$$

Here, Cd is the flow coefficient, A is an injection hole outlet surface area, ΔP is a difference in pressure between a pressure inside of the suction chamber pressure and a pressure outside of an injector hole, and ρ is a fuel density.

Hence, when the injection hole outlet surface area increases, the injection rate dQ also increases. Variation in the injection rate dQ is a phenomenon observed when injection hole corrosion occurs, and can therefore be set as an index for determining the presence of injection hole corrosion. Note that an increase in the injection rate dQ may also be learned as a reduction in the fuel inlet pressure Pcr. Further, a momentary injection rate dQ obtained at a desired timing may be employed as the maximum injection rate dQmax. As shown in FIG. 7, for example, the injection rate dQ at a timing where the fuel inlet pressure Pcr becomes substantially constant may be employed.

The third index relates to variation in the injection period tinj. Even when injection hole corrosion occurs, the fuel injection amount per one injection does not vary. Therefore, when the maximum injection rate dQmax increases, the injection period tinj is shortened. Accordingly, the injection period tinj may also be used as an index for determining the presence of injection hole corrosion. The phenomenon whereby the injection period tinj shortens when injection hole corrosion occurs can also be explained by an increase in an opening speed of the needle valve, which occurs when the pressure in the suction chamber decreases early due to an increase in the maximum injection rate dQmax.

When either one of the second condition relating to the second index and the third condition relating to the third index is satisfied together with the first condition, it may be determined that injection hole corrosion has occurred.

An example of control based on determinations of the three conditions described above will now be described using a flowchart shown in FIG. 4. Note that in this embodiment, as described above, the conditions are determined on the basis of variation in the fuel inlet pressure Pcr, which is measured by the pressure gauge 115.

First, in step S1, a determination is made as to whether or not an injection hole corrosion determination injection condition is satisfied. To determine whether or not injection hole corrosion has occurred, each index is compared with a corresponding reference value. Here, indices set at the time of factory shipping, for example, may be employed as the reference values. In other words, the indices are compared respectively with so-called normal condition values obtained when injection hole corrosion has not occurred. The injection hole corrosion determination injection condition is aligned with a reference value obtaining condition. This condition may be set as desired, but by setting a region in which the injection amount is comparatively large, such as a timing of a medium/high injection pressure, for example, differences are more likely to appear, increasing accuracy of the injection hole corrosion determination.

When the determination of step S1 is negative, the processing returns. When the determination of step S1 is affirmative, the processing advances to step S2. In step S2, a waveform of the fuel inlet pressure Pcr is obtained. Next, in step S3, the injection hole corrosion determination indices (the first to third indices) are detected. In other words, the fuel inlet pressure waveform shown in FIG. 6 is obtained.

In step S4 following step S3, a determination is made as to whether or not an opening behavior condition serving as the first index, or in other words the first condition relating to the first index, is satisfied. More specifically, the fuel inlet pressure Pcr in the open period during when the injection hole is open is compared with a reference fuel inlet pressure Pcr, and a determination is made as to whether or not an amount of variation in the fuel inlet pressure Pcr is equal to or smaller than a predetermined value. When the determination of step S4 is negative, the processing advances to step S7, where it is determined that injection hole corrosion has not occurred. The processing is then returned. When the determination of step S4 is affirmative, on the other hand, the processing advances to step S5. In step S5, a determination is made as to whether or not a condition relating to the maximum injection rate dQmax serving as the second index, or in other words the second condition relating to the second index, is satisfied. More specifically, the maximum injection rate dQmax is compared with a reference dQmax to determine whether or not the maximum injection rate dQmax has increased. Note that when dQmax increases, the fuel inlet pressure Pcr falls below the reference fuel inlet pressure Pcr. When the determination of step S5 is affirmative, the processing advances to step S8, where it is determined that injection hole corrosion has occurred. The processing is then returned. In other words, injection hole corrosion is determined to have occurred when both the first condition and the second condition are satisfied.

When the determination of step S5 is negative, on the other hand, the processing advances to step S6. In step S6, a determination is made as to whether or not a condition relating to the fuel injection period tinj serving as the third index, or in other words the third condition relating to the third index, is satisfied. More specifically, the fuel injection period tinj is compared with a reference injection period tinj to determine whether or not the fuel injection period tinj has become shorter. When the determination of step S6 is affirmative, the processing advances to step S8, where it is determined that injection hole corrosion has occurred. The processing is then returned. In other words, injection hole corrosion is determined to have occurred when both the first condition and the third condition are satisfied. When the determination of step S6 is negative, on the other hand, or in other words when neither the second condition nor the third condition is satisfied, the processing advances to step S7, where it is determined that injection hole corrosion has not occurred. The processing is then returned.

Note that the order in which the processing of step S5 and step S6 is performed may be reversed. Moreover, as long as the first to third conditions can ultimately be determined, there are no limitations on the order in which the processing of step S4 to step S6 is performed. Furthermore, the processing may be returned when the second condition or the third condition is satisfied together with the first condition, or injection hole corrosion may be determined to have occurred when all of the conditions are satisfied.

Figure 5:
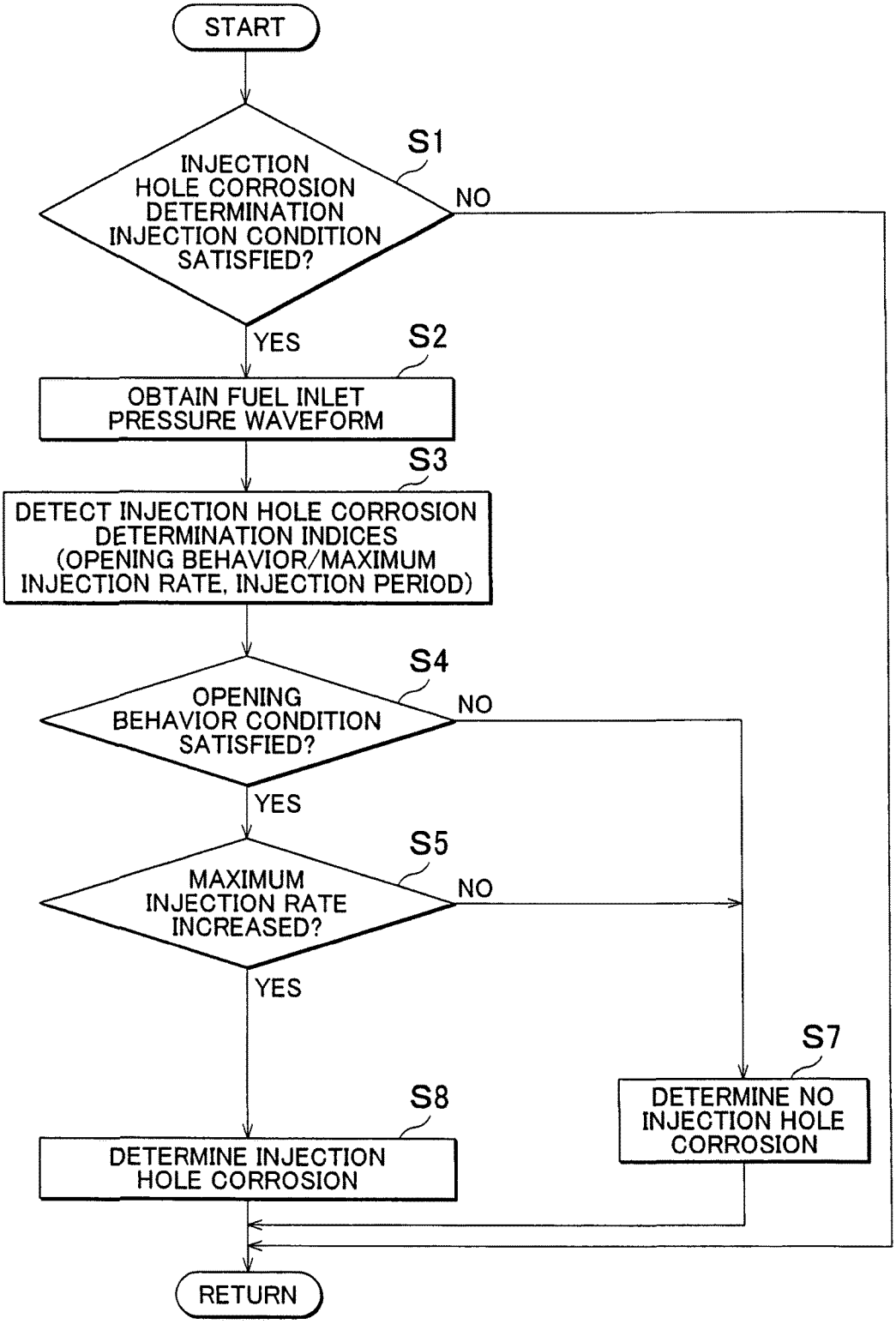
FIG. 5 is a flowchart showing another example of control of the fuel injection apparatus.

Further, as shown in FIG. 5, the processing of step S6 in FIG. 4 may be omitted. More specifically, when the determination of step S5 is negative, the processing advances to step S7, where it is determined that injection hole corrosion has not occurred, and then the processing is returned. When the determination of step S5 is affirmative, meanwhile, the processing advances to step S8, where it is determined that injection hole corrosion has occurred, and then the processing is returned. In other words, injection hole corrosion is determined to have occurred when the condition relating to the maximum injection rate dQmax serving as the second index is satisfied in addition to the opening behavior condition serving as the first index. Furthermore, according to a modified example shown in FIG. 6, the processing of step S5 in FIG. 4 may be omitted. More specifically, when the determination of step S6 is negative, the processing advances to step S7, where it is determined that injection hole corrosion has not occurred, and then the processing is returned. When the determination of step S6 is affirmative, meanwhile, the processing advances to step S8, where it is determined that injection hole corrosion has occurred, and then the processing is returned. In other words, injection hole corrosion is determined to have occurred when the condition relating to the injection period serving as the third index is satisfied in addition to the opening behavior condition serving as the first index.

With the fuel injection apparatus 1 according to this embodiment, as described above, the presence of injection hole corrosion caused by condensed water in the injector can be determined appropriately.

Figure 12:
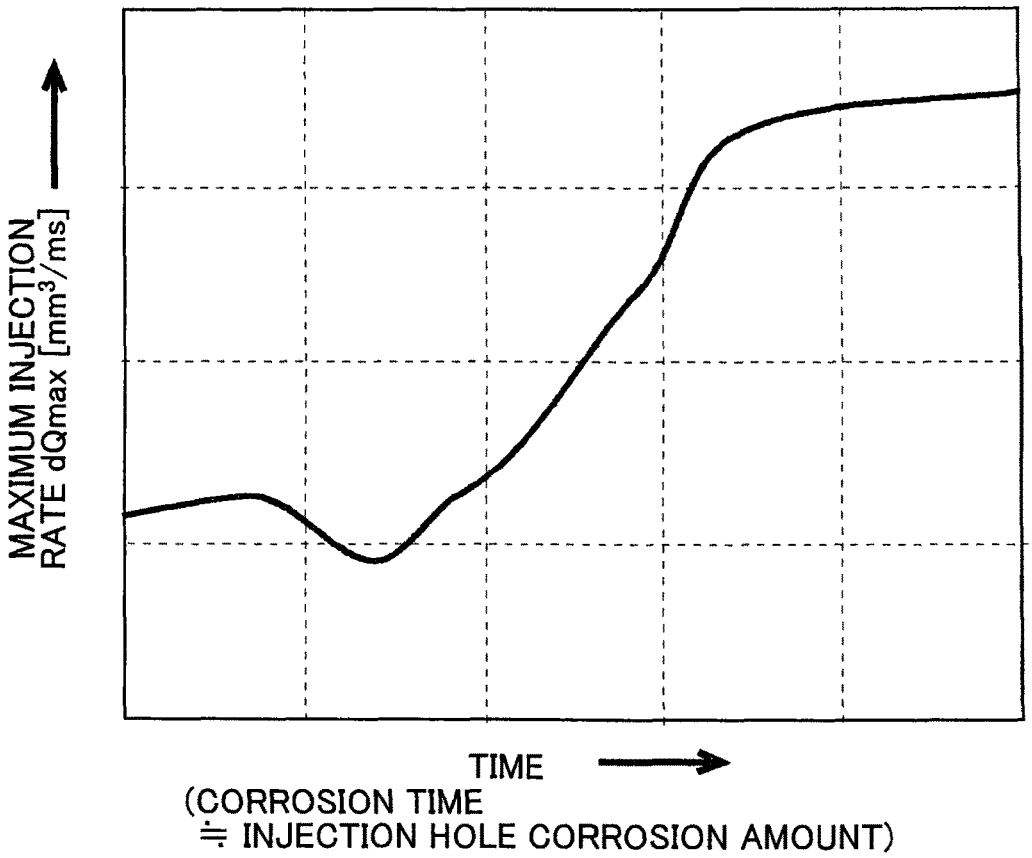
FIG. 12 is a graph showing an example of a relationship between an injection hole corrosion amount and a maximum injection rate.
Figure 13:
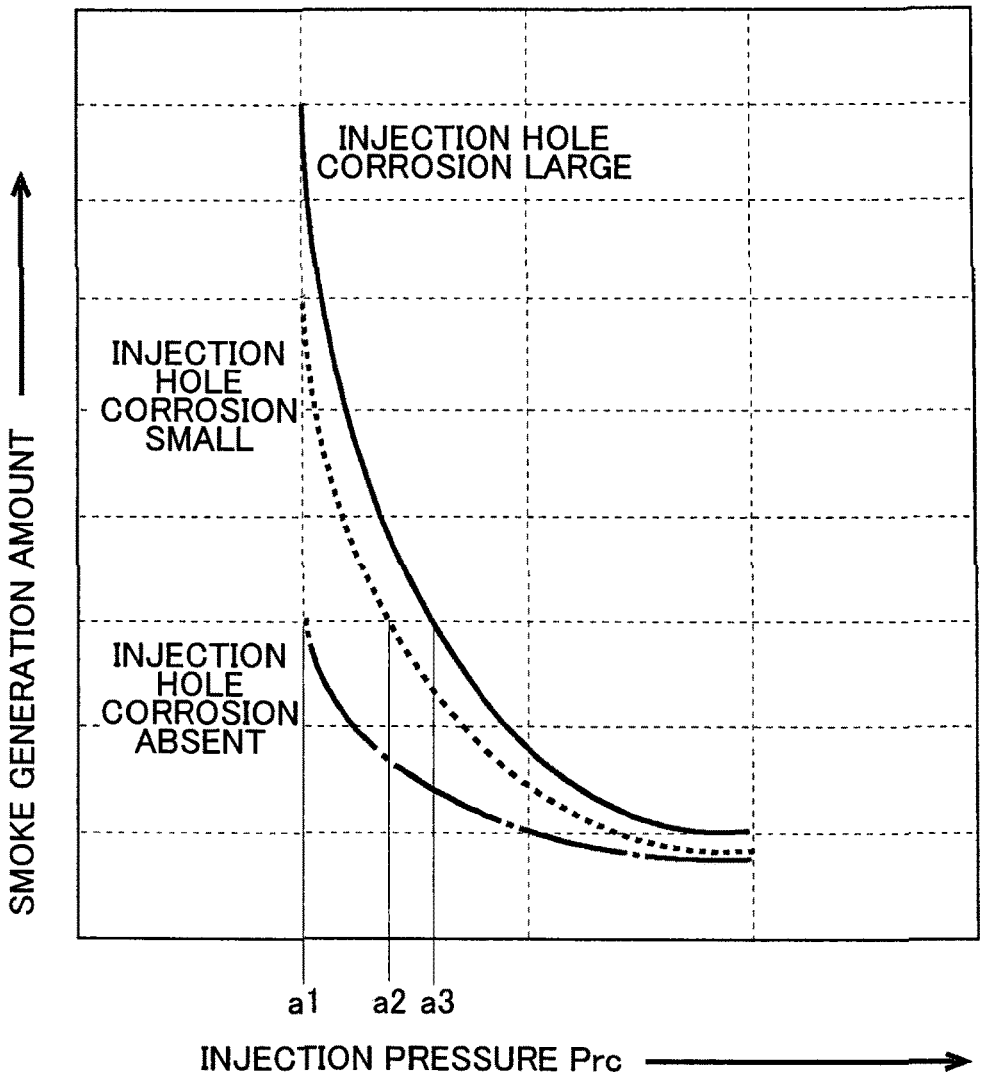
FIG. 13 is a graph showing an example of a relationship between the injection hole corrosion amount, an injection pressure, and a smoke generation amount.

Next, referring to FIGS. 11 to 13, countermeasures taken when injection hole corrosion is confirmed will be described. In consideration of the fact that when injection hole corrosion occurs, a smoke characteristic deteriorates, the purpose of the countermeasures is to implement actions to offset the deterioration of the smoke characteristic. In this embodiment, the injection pressure (the fuel pressure) is corrected.

Figure 11A:
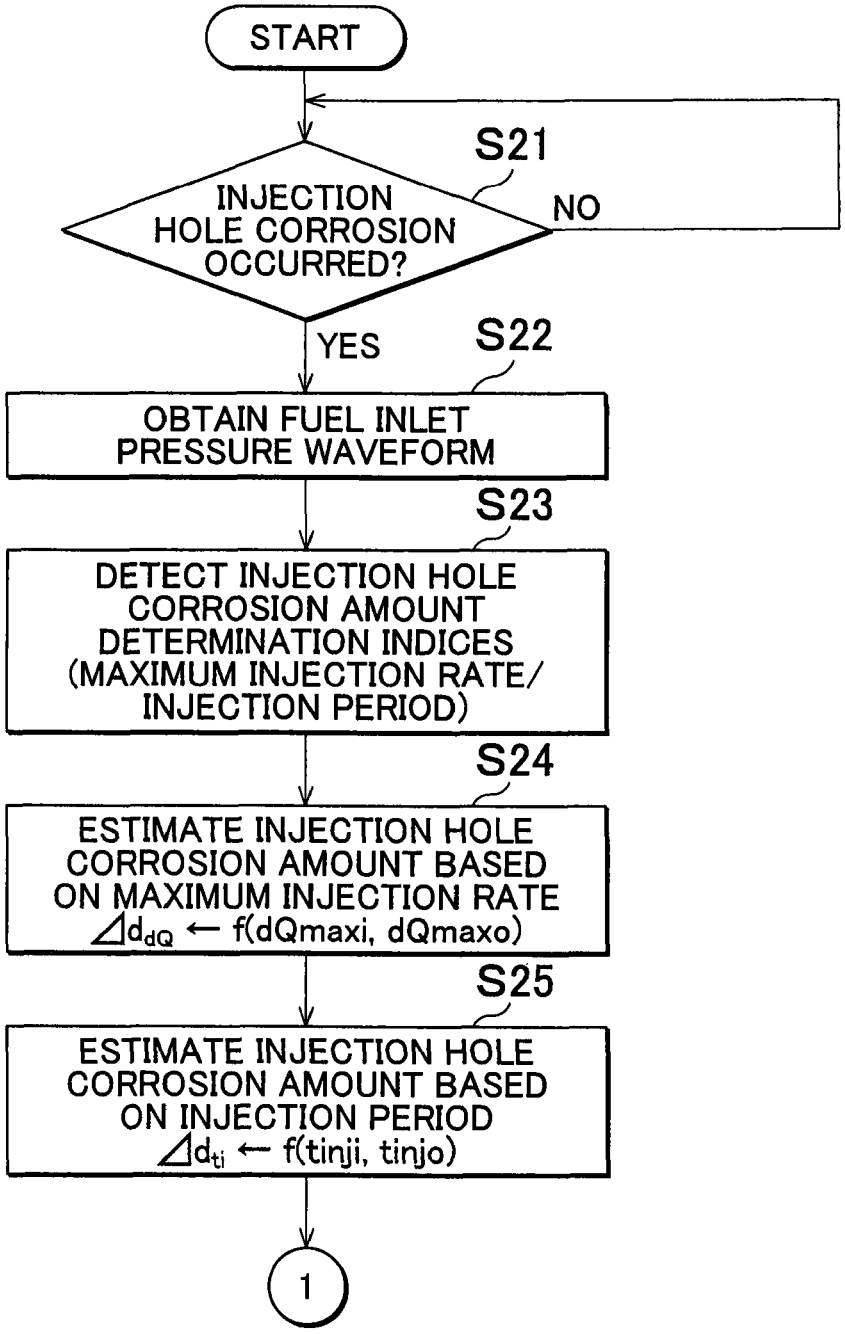
FIGS. 11A and 11B are a flowchart showing an example of actions implemented when injection hole corrosion is detected.
Figure 11B:
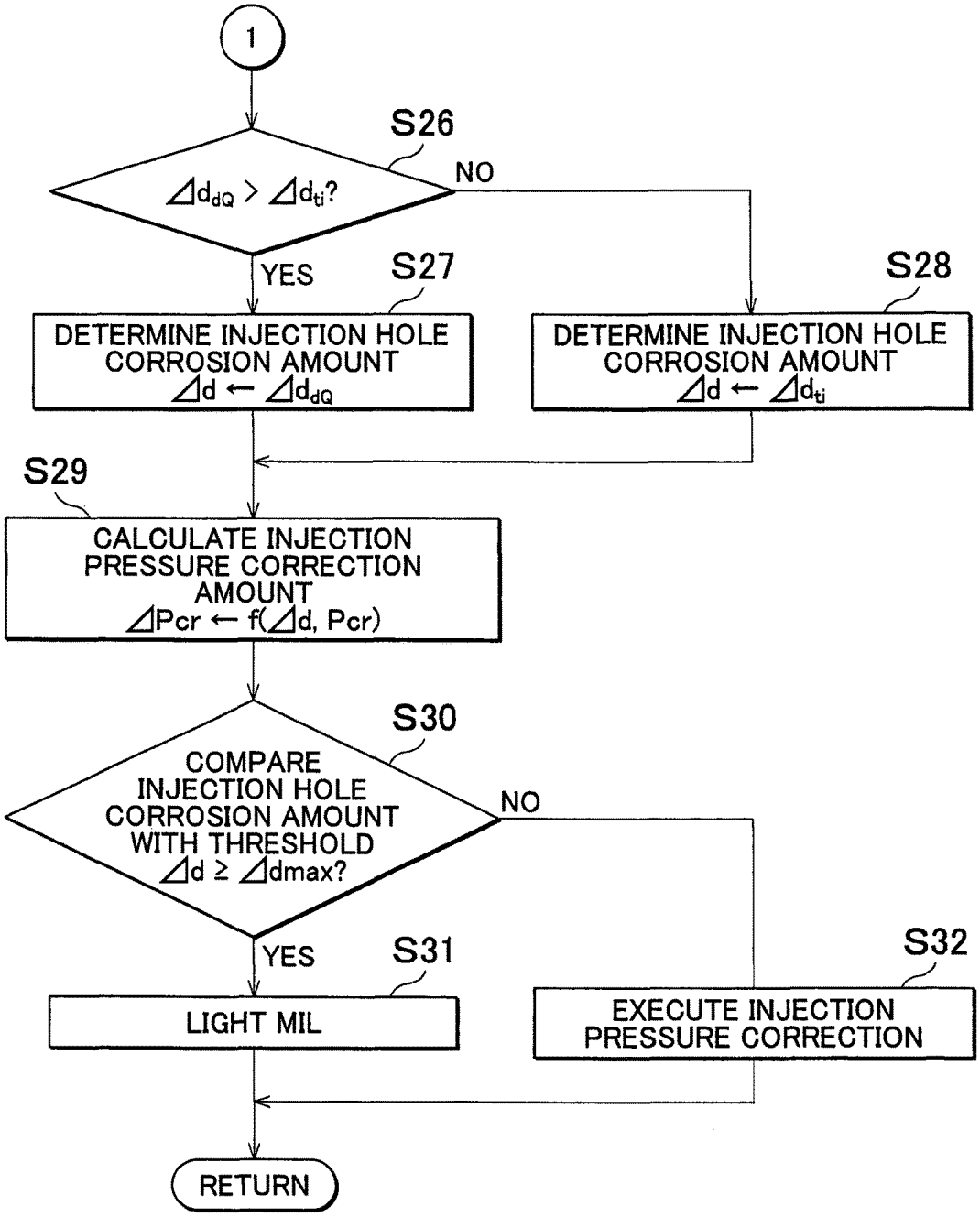

Referring to FIGS. 11A and 11B, in step S21, a determination is made as to whether or not injection hole corrosion has occurred. More specifically, a determination is made as to whether or not the injection hole corrosion determination has been performed in step S8 of the flowchart shown in FIGS. 4, 5 and 6. The processing of step S21 is repeated until the determination becomes affirmative. When the determination of step S21 is affirmative, the processing advances to step S22. In step S22, the waveform of the fuel inlet pressure Pcr is obtained again. The waveform obtained in step S2 can be used as this waveform. In step S23 following step S22, the injection hole corrosion amount determination indices are detected from the obtained waveform. More specifically, the maximum injection rate dQmax serving as the second index and the fuel injection period tinj serving as the third index are detected. In this embodiment, an injection hole corrosion amount Δd serving as a parameter on which to evaluate the injection hole corrosion amount is calculated on the basis of the second index and the third index. In this embodiment, the injection hole corrosion amount Δd itself is calculated, but a value having a correlation with the injection hole corrosion amount Δd may be used as the parameter on which to evaluate the injection hole corrosion amount. Note that either one of the second index and the third index may be used as the injection hole corrosion amount determination index, and the parameter on which to evaluate the injection hole corrosion amount may be calculated on the basis of the used index.

In step S24 following step S23, an injection hole corrosion amount $\Delta d_{dQ}$ based on the maximum injection rate dQmax is calculated. The injection hole corrosion amount $\Delta d_{dQ}$ can be calculated from f (dQmaxi, dQmax0). More specifically, the injection hole corrosion amount $\Delta d_{dQ}$ can be determined from a difference between dQmaxi and dQmax0. Here, the suffix i denotes a measurement value obtained in step S22, and the suffix 0 denotes a reference value serving as a comparison subject. This applies likewise to suffixes used in the following description.

In step S25 following step S24, an injection hole corrosion amount $\Delta d_{ti}$ based on the injection period tinj is calculated. The injection hole corrosion amount $\Delta d_{ti}$ can be calculated from f (tinji, tinj0). More specifically, the injection hole corrosion amount $\Delta d_{ti}$ can be determined from a difference between tinji and tinj0.

Note that there are no limitations on the order in which step S24 and step S25 are performed. In other words, the order in which the two steps are performed may be reversed, or the two steps may be performed simultaneously in parallel.

In step S26 following step S25, a determination is made as to whether $\Delta d_{dQ}$ or $\Delta d_{ti}$ is larger. When the determination is affirmative, or in other words when $\Delta d_{dQ}$ is determined to be larger, the processing advances to step S27, where $\Delta d_{dQ}$ is employed as the injection hole corrosion amount Δd. When, on the other hand, the determination is negative, or in other words when $\Delta d_{ti}$ is determined to be larger, the processing advances to step S28, where $\Delta d_{ti}$ is employed as the injection hole corrosion amount Δd. By employing the larger numerical value as Δd in this manner, the determination can be made more safely. In this embodiment, the two values are compared and the larger value is employed, but instead, an average value of the two values may be employed as the injection hole corrosion amount Δd.

In step S29 following step S27 or step S28, a fuel pressure correction value ΔPcr is calculated on the basis of the injection hole corrosion amount Δd. ΔPcr is calculated from f (Δd, ΔPcr). Here, referring to FIG. 13, it is evident that when a corrosion time increases, leading to an increase in the injection hole corrosion amount, the maximum injection rate dQmax likewise tends to increase. Typically, an increase in the maximum injection rate dQmax leads to an increase in a smoke generation amount. Referring to FIG. 13, it is evident that when the fuel pressure remains constant, the smoke generation amount increases as injection hole corrosion advances, or in other words as the injection hole corrosion amount increases. This tendency appears more strikingly toward a region in which the fuel inlet pressure Pcr, or in other words the injection pressure (the fuel pressure) is low. For example, if a user wishes to set an equivalent smoke generation amount to an amount of smoke generated when fuel is injected at an injection pressure a1 while the injector 107 is still new such that injection hole corrosion has not yet occurred, the fuel must be injected at an injection pressure a2 in a case where the injection hole corrosion amount is indicated to be small in FIG. 13. Similarly, in a case where the injection hole corrosion amount is indicated to be large in FIG. 13, the fuel must be injected at an injection pressure a3. Hence, in step S29, the fuel pressure (the injection pressure) is varied such that the deterioration of the smoke characteristic can be offset. Referring to FIGS. 11A and 11B, an amount by which the fuel pressure is corrected can be determined in accordance with a smoke amount increase. When injection hole corrosion occurs, no variation is seen in the fuel injection amount, and therefore an air-fuel ratio does not vary either. Hence, the fuel pressure is corrected so as to be able to offset the smoke amount increase.

In step S30 following step S29, a determination is made as to whether or not the injection hole corrosion amount equals or exceeds a threshold Δdmax of the injection hole corrosion amount Δd. Here, the threshold Δdmax is set at a value at which it may be impossible to avoid a problem that cannot easily be dealt with in the fuel injection apparatus 1, such as a filter blockage, even by increasing the fuel pressure. When the determination of step S30 is affirmative, the processing advances to step S31, where an MIL is lit. As a result, a user is prompted to implement an action such as taking the vehicle to a repair shop. When the determination of step S30 is negative, on the other hand, injection pressure correction is executed on the basis of the correction amount calculated in step S29. As a result, the increase in the smoke generation amount caused by the deterioration of the smoke characteristic can be counteracted. Following steps S31 and S32, the processing is returned.

Note that in addition to the action of step S32, an injection hole corrosion countermeasure may be implemented. For example, a post-engine stoppage fuel injection may be performed to counteract the injection hole corrosion. When plating processing has been implemented on the injector 107 and the plating has peeled away, an action such as performing a post-engine stoppage fuel injection is effective. In other words, progression of the corrosion that occurs when the plating peels away can be delayed. A determination as to whether or not the plating has peeled away can be made similarly to estimation of the injection hole corrosion amount. Further, either an identical value to the threshold Δdmax shown in the flowchart of FIGS. 11A and 11B or a different value may be employed as a threshold for determining whether or not to implement the injection hole corrosion countermeasure. Moreover, the injection hole corrosion countermeasure may be implemented independently regardless of whether or not injection pressure correction is executed.

Figure 14:
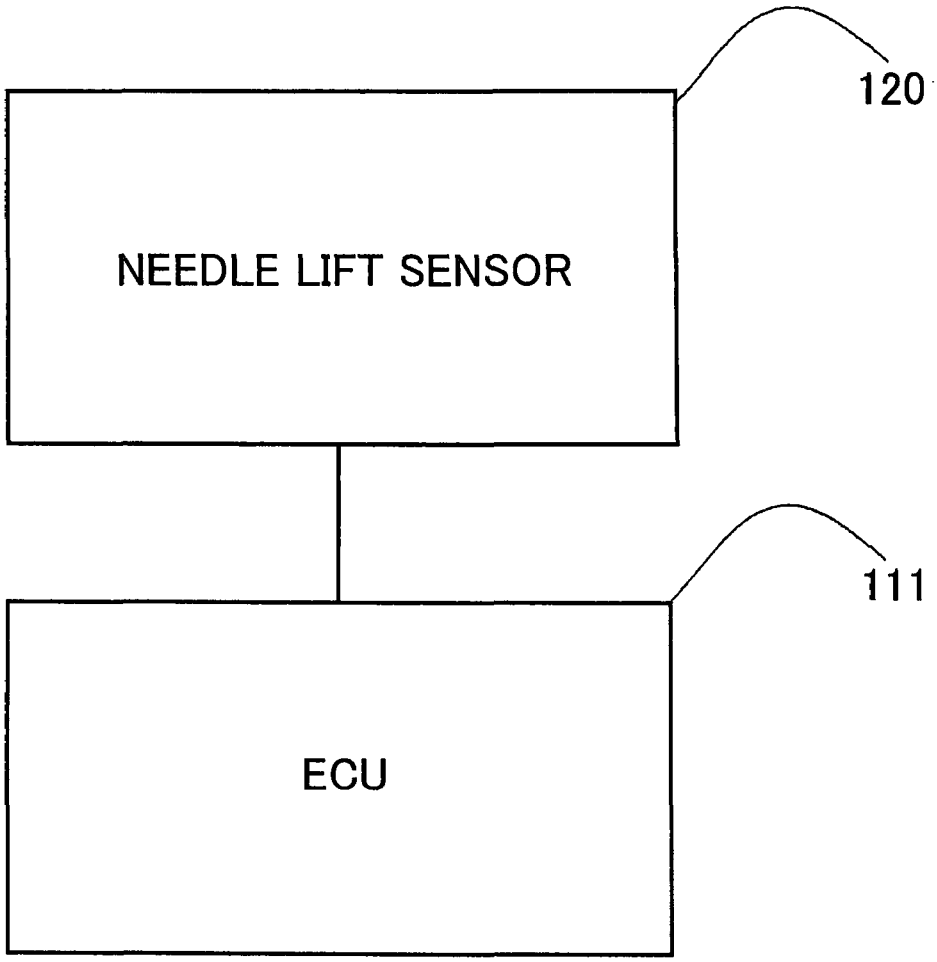
FIG. 14 is a block diagram showing a part of a fuel injection apparatus according to a second embodiment.

(Second Embodiment) Next, a second embodiment will be described with reference to FIGS. 14 to 16. In the first embodiment, the waveform of the fuel inlet pressure Pcr is obtained in order to obtain the first to third indices. In the second embodiment, on the other hand, as shown in FIG. 14, the various indices are obtained by analyzing a needle behavior using a needle lift sensor 120 that is electrically connected to the ECU 111. More specifically, a needle speed and a needle lift immediately after opening of the injector 107 is employed as the first index relating to the opening behavior of the injector 107.

Figure 15:
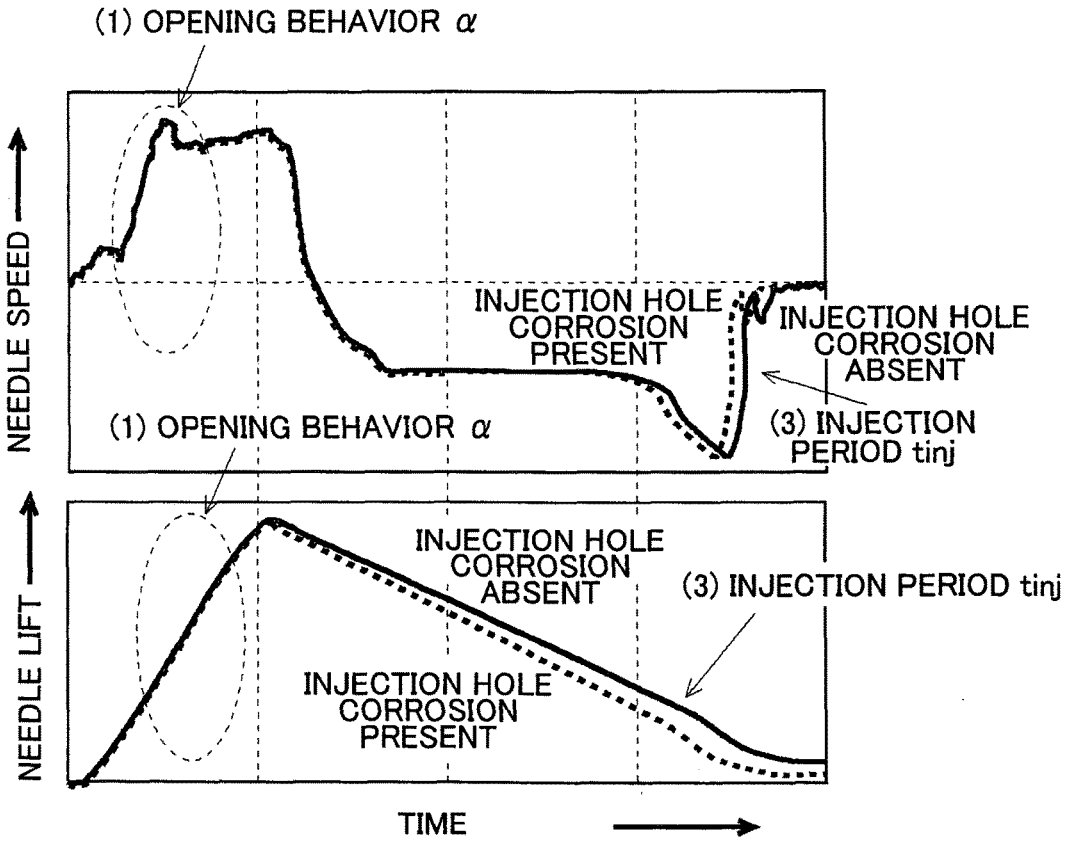
FIG. 15 is an illustrative view showing an example of variation in a needle speed and a needle lift.
Figure 16:
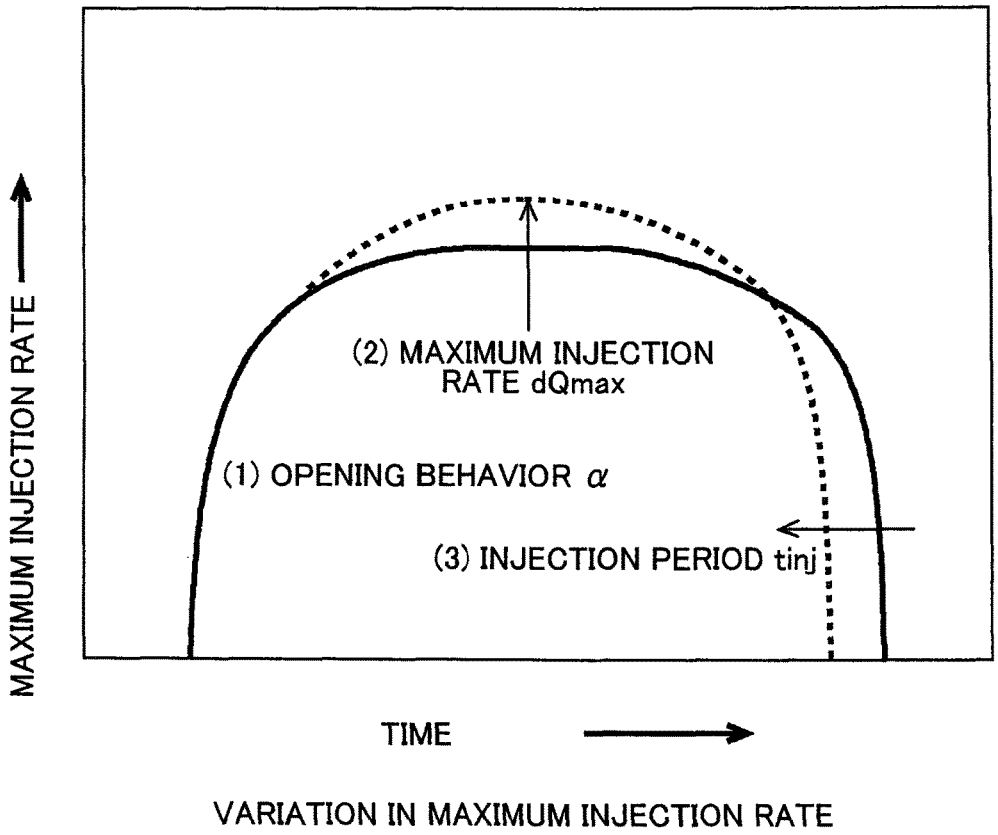
FIG. 16 is an illustrative view showing variation in the maximum injection rate.

FIG. 15 shows aging variation in the needle speed and the needle lift. It can be seen that the needle lift and the needle speed within a period immediately after opening, which is set as desired in a similar manner to the first embodiment, differ depending on whether or not injection hole corrosion has occurred. In other words, it can be seen that the first condition relating to the first index is satisfied. Further, focusing on the needle speed immediately before closing, the needle speed when injection hole corrosion has occurred is higher than the needle speed when injection hole corrosion has not occurred, and therefore the fuel injection period tinj is shorter. In other words, it can be seen that the third condition relating to the third index is satisfied. Variation in the maximum injection rate, shown in FIG. 16, can be calculated from the variation in the needle lift and needle speed shown in FIG. 15, and it is evident from FIG. 16 that the maximum injection rate dQmax has increased. In other words, it can be seen that the second condition relating to the second index is also satisfied.

Hence, the various indices can also be obtained on the basis of the behavior of the needle provided in the injector 107, whereupon the presence of injection hole corrosion can be determined on the basis of the obtained indices.

The embodiments described above are merely examples of implementation of the invention, and the invention is, not limited thereto. As is evident from the above description, various amendments may be made to the embodiments within the scope of the invention, and moreover, various other embodiments are included within the scope of the invention.

The invention claimed is:

1. A fuel injection apparatus comprising:

a first obtaining unit that obtains a first index relating to an opening behavior of an injector;

a second obtaining unit that obtains at least one of a second index relating to a maximum injection rate of the injector and a third index relating to an fuel injection period; and a calculation unit that determines that injection hole corrosion has occurred in the injector when a first condition relating to the first index is established and at least one of a second condition relating to the second index and a third condition relating to the third index is established, wherein the first condition is established when an amount of variation in the first index is equal to or smaller than a predetermined value, and the second condition is established when the second index increases relative to a reference value, and the third condition is established when the third index shortens relative to a reference value.

2. The fuel injection apparatus according to claim 1, wherein the first index relating to the opening behavior of the injector is at least one of a reduction amount and a reduction speed of a fuel pressure of fuel supplied to the injector immediately after the injector is opened, and the fuel pressure being measured by a pressure gauge.

3. The fuel injection apparatus according to claim 1, wherein the fuel injection apparatus includes a needle and the first index relating to the opening behavior of the injector is at least one of a needle speed and a needle lift determined by a needle lift sensor immediately after the injector is opened.

4. The fuel injection apparatus according to claim 1, wherein the calculation unit calculates a parameter on which to evaluate an injection hole corrosion amount in the injector on the basis of at least one of the second index and the third index, and corrects a fuel pressure of fuel supplied to the injector on the basis of the parameter, and the fuel pressure being measured by a pressure gauge.

5. The fuel injection apparatus according to claim 4, wherein the calculation unit determines a correction amount to be applied to the fuel pressure on the basis of a smoke amount increase that corresponds with an increase in the maximum injection rate of the injector and an increase in the injection hole corrosion amount.

6. The fuel injection apparatus according to claim 1, wherein the second index is a maximum injection rate of the injector as determined from a variation in a fuel pressure of fuel supplied to the injector and measured by a pressure gauge.

7. The fuel injection apparatus according to claim 1, wherein the third index is the fuel injection period of the injector as determined from a variation in a fuel pressure of fuel supplied to the injector and measured by a pressure gauge.

8. A control method for a fuel injection apparatus, comprising:

obtaining a first index relating to an opening behavior of an injector;

obtaining at least one of a second index relating to a maximum injection rate of the injector and a third index relating to an fuel injection period; and determining that injection hole corrosion has occurred in the injector when a first condition relating to the first index is established and at least one of a second condition relating to the second index and a third condition relating to the third index is established, wherein the first condition is established when an amount of variation in the first index is equal to or smaller than a predetermined value, and the second condition is established when the second index increases relative to a reference value, and the third condition is established when the third index shortens relative to a reference value.

* * * * *